US006230430B1

(12) United States Patent
Gosselin

(10) Patent No.: US 6,230,430 B1
(45) Date of Patent: May 15, 2001

(54) GUN TOOL

(76) Inventor: Christopher M. Gosselin, 9 Pennywise La., Old Saybrook, CT (US) 06475

( * ) Notice: Subject to any disclaimer, the term of this patent is extended or adjusted under 35 U.S.C. 154(b) by 0 days.

(21) Appl. No.: 09/290,045

(22) Filed: Apr. 12, 1999

(51) Int. Cl.[7] ..... F41C 27/00
(52) U.S. Cl. ..... 42/90
(58) Field of Search ..... 42/90, 95, 106

(56) References Cited

U.S. PATENT DOCUMENTS 4,949,496 * 8/1990 Stephan ..... 42/90
5,233,124 * 8/1993 Peterson ..... 42/90
5,416,940 * 5/1995 Bandera ..... 42/90
5,417,003 * 5/1995 Claveau ..... 42/90
5,782,031 * 7/1998 Bourgeois ..... 42/90

* cited by examiner

*Primary Examiner*—Charles T. Jordan
*Assistant Examiner*—Elizabeth Shaw
(74) *Attorney, Agent, or Firm*—Fattibene & Fattibene; Paul A. Fattibene; Arthur T. Fattibene

(57) ABSTRACT

A firearm tool having a width adapted to securely fit within the handle of a pistol or firearm. A firearm tool made from a blank planar material has a punch on one end and a centrally disposed aperture. The width of the tool may be adjusted to accommodate different dimensions of a handle chamber within the handle of a firearm or pistol. The aperture mates with a portion of the barrel of a gun or pistol to provide additional leverage in utilizing the punch for removing press fit pins to completely disassemble the firearm. A screwdriver tab may be placed on the other end of the firearm tool. The firearm tool may be conveniently stored in the handle of a gun and therefore, is always accessible when needed in disassembling a firearm.

17 Claims, 2 Drawing Sheets

GUN TOOL

FIELD OF THE INVENTION

The present invention relates in general to a tool for use with a firearm, and particularly to a tool held in the handle of a pistol.

BACKGROUND OF THE INVENTION

It is often necessary to disassemble and clean firearms and, in particular, pistols. Pistols, because of their relatively small size, are often carried on a person. When being carried on a person or in the field, it is often necessary to also carry different accessories or tools for the pistol. Most pistols are designed to be partially disassembled in the field should they malfunctions or requires cleaning. To more completely disassemble most firearms, and in particular pistols, a punch is often required to be used. However, a punch is relatively difficult or inconvenient to carry and may be lost, misplaced, or forgotten. Accordingly, it is often difficult to fully disassemble a firearm as might be required in the field for cleaning or repair. It may be desirable to disassemble, repair, or clean a pistol in the field, and depending upon the circumstances, it may be necessary to disassemble, repair, or clean a pistol quickly without the ability to seek additional tools or assistance. Therefore, there is a need for a simple and easy to use tool that is always accessible and easily stored, and particularly when the pistol or firearm is in the field.

SUMMARY OF THE INVENTION

The present invention is a tool for use in disassembling a firearm, and in particular a pistol, that may be stored in a recess in the handle of a firearm. A planar tool has a cylindrical punch on one end and expandable or adjustable sides for securely retaining the tool within the handle of the firearm or pistol. A rectangular aperture in the tool is used in combination with the barrel of a pistol to provide additional leverage in using the tool. A screwdriver tab is placed on one end of the tool. An elongated opening is also placed in one end of the tool to assist removal of the tool from the handle of a pistol. The tool is easily manufactured out of sheet material and securely retained within the handle of a firearm or pistol, ready for use in the field.

Accordingly, it is an object of the present invention to provide a tool for use with a firearm and in particular a pistol that is readily accessible and stored within the firearm.

It is another object of the present invention to provide a tool for easily removing pins or for use as a prying tool.

It is an advantage of the present invention that it fits within the handle of a firearm or a pistol.

It is an additional advantage of the present invention that it can be easily attached to the barrel of a pistol to provide additional leverage in removing pins or other parts.

It is a feature of the present invention that an aperture is formed within the tool that mates with a portion of the barrel of a firearm or a pistol.

It is another feature of the present invention that the sides of the tool are adjustable in width so that the tool will securely fit within the handle of a gun without unintentionally moving or rattling.

These and other objects, advantages, and features will be readily apparent in view of the following detailed description.

DETAILED DESCRIPTION OF THE PREFERRED EMBODIMENTS

Figure 1:
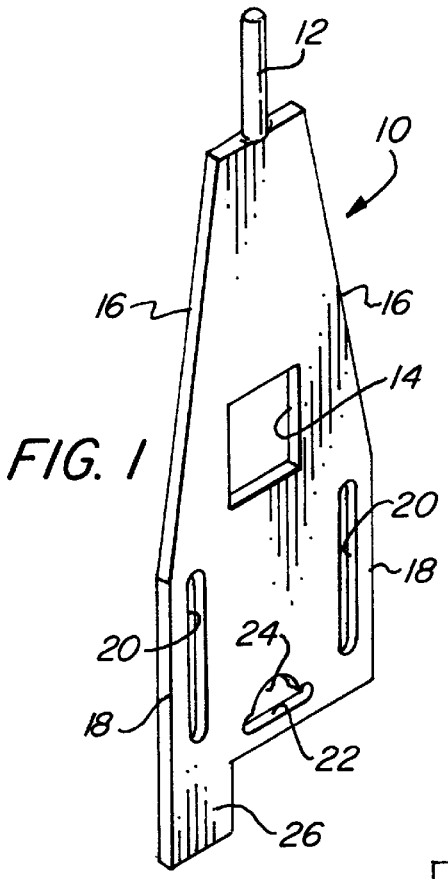
FIG. 1 is a perspective view of the present invention.

FIG. 1 is a perspective view illustrating the firearm tool 10 of the present invention. The firearm tool 10 is made from a planar blank or a sheet like material, such as stainless steel. The firearm tool 10 may be punched from a blank, drilled, or milled. The firearm tool 10 has a punch 12 on one end. The punch 12 may be cylindrical or partly cylindrical and have a diameter and length sufficient to remove a pin. An aperture 14, in the shape of a quadrilateral and preferably a rectangle, is formed generally centrally within the firearm tool 10. A portion of the longitudinal sides of the firearm tool 10 are angled forming angled sides 16. A remaining portion of the longitudinal sides of the firearm 10 are straight, forming straight sides 18. Adjacent the straight sides 18 is an elongated slot 20 formed parallel to the straight sides 18. At the other end of the firearm tool 10 is an elongated opening 22 in combination with a semi-circular opening 24. Formed on the other end of the firearm tool 10 is a screwdriver tab 26.

Figure 2:
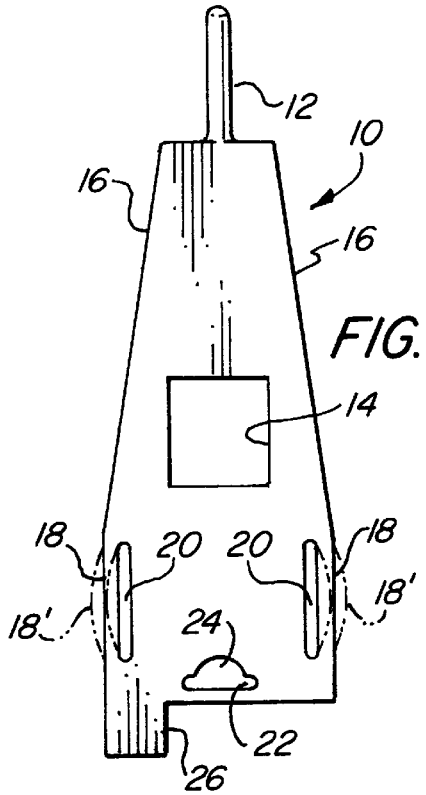
FIG. 2 is an elevational view of the present invention.

FIG. 2 is an elevational view illustrating the adjustability of the straight sides 18. The straight sides 18 are adjustable so as to selectively increase or expand the width of the firearm tool 10. The straight sides 18 may be adjusted outwardly to a different position, illustrated in phantom at 18'. A screwdriver may be inserted into the slot 20 and twisted to adjust the straight sides 18 to a wider position, illustrated in phantom at 18'. The width may also be reduced by gently tapping the sides 18 with an appropriate tool, such as a hammer. The width of the firearm tool 10 can therefore be easily adjusted by the user to accommodate a range of widths. This permits the firearm tool to be securely held with a handle of a firearm or pistol.

Figure 3:
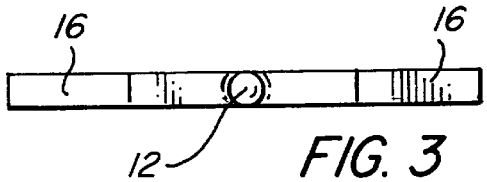
FIG. 3 is a plan view of the present invention.

FIG. 3 is a plan view illustrating the generally cylindrical punch 12. The punch 12 may have a round cross section or be slightly oblong or oval depending upon the manufacturing steps utilized in the manufacture of the firearm tool 10.

Referring to FIGS. 1–3 the preferred dimensions of the firearm tool 10 are as follows: the overall longitudinal length ranges from 1.5 inches (3.81 cm) to 2.6 inches (6.60 cm); the overall width approximately 0.892 inches (2.27 cm); the length of the punch 12 approximately 0.5 inches (1.27 cm); the length of the straight sides 18 may range from 0.35 inches (0.89 cm) to 0.6 inches (1.52 cm); the width adjacent the punch approximately 0.45 inches (1.14 cm); the length of the expansion slot 20 may range from 0.65 inches (1.65 cm) to 1.25 inches (3.18 cm); the aperture 14 may have a width of approximately 0.38 inches (0.97 cm) and a length ranging between 0.41 inches (1.04 cm) to 0.465 inches (1.18 cm); and the thickness of the planar blank may be approximately 3/32 inches (0.23 cm). While these dimensions are generally the preferred dimensions, clearly the dimensions may vary depending upon the particular application and should not be considered to limit the invention in any way.

Figure 4:
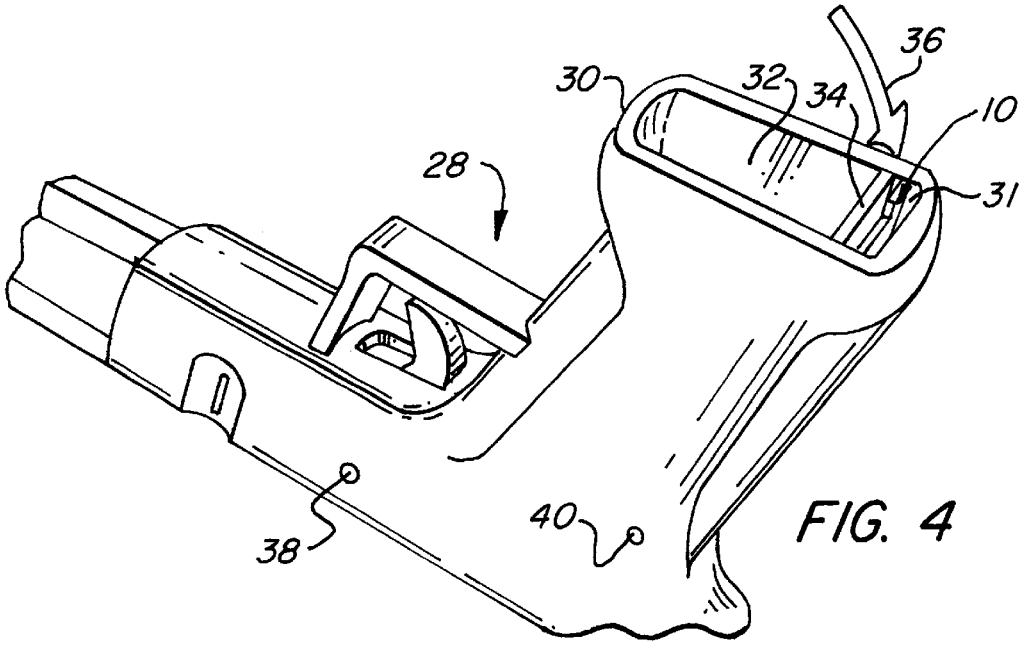
FIG. 4 is a perspective view illustrating placement of the present invention within a portion of the handle of a pistol.

FIG. 4 is a perspective view illustrating the placement of the firearm tool 10 within a portion of a handle 30 of a pistol 28. In many firearms or pistols such as a Glock pistol manufactured by Glock, Inc., there is a handle cavity 31 adjacent the magazine opening 32. A web 34 generally separates the handle chamber 31 from the magazine opening 32. Arrow 36 illustrates the placement of the firearm tool 10 within the handle chamber 31. The width of the firearm tool may be manufactured to different dimensions that substantially fit within the handle chamber 31 of a variety of different firearms or pistols. Adjustments may be made to the width of the firearm tool 10 to accommodate variances of a particular firearm and to assure that the firearm tool 10 snugly and securely fits within the handle chamber 31 in the handle 30. The adjustments may be made as illustrated in FIG. 2 by adjusting the straight sides 18. Additionally illustrated in FIG. 4, are locations of several pins requiring removal to fully disassemble the pistol 28. The trigger pin 38 and the trigger housing pin 40 are illustrated.

Figure 5:
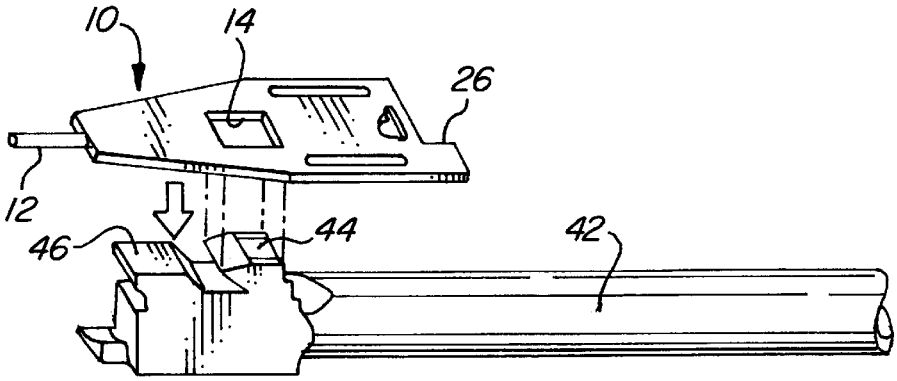
FIG. 5 is a perspective view illustrating placement of the present invention on the removed barrel of a pistol.

FIG. 5 is a perspective view illustrating the use of the firearm tool 10 with a disassembled barrel 42 of a pistol. Generally, the barrel of a pistol may be removed without the need of any tool. Once the barrel is removed, aperture 14 in the firearm tool 10 may be placed over a locking block key 44 on P-2284 barrel 42. The surface of the firearm tool between the punch 12 and the aperture 14 securely rests on surface 46.

Figure 6:
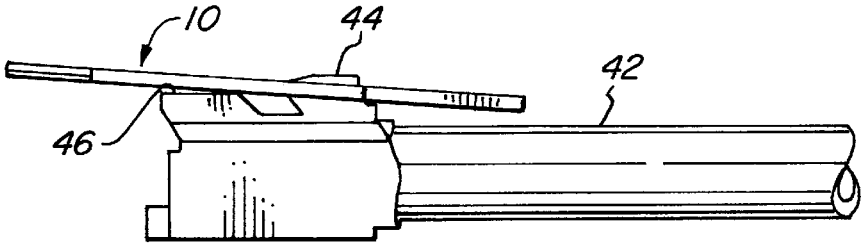
FIG. 6 is an elevational view illustrating the present invention held on the barrel of a pistol.

FIG. 6 is an elevational view more clearly illustrating the placement of the firearm tool 10 onto the removed barrel 42. Once the firearm tool 10 is placed or interlocked with the locking block key 44, the effective length of the tool is increased to provide an additional handle and leverage in using the punch 12 formed as part of the firearm tool 10. This additional leverage is particularly advantageous when the pins may be tight fitting, such as when the firearm is new or has been reconditioned.

Figure 7:
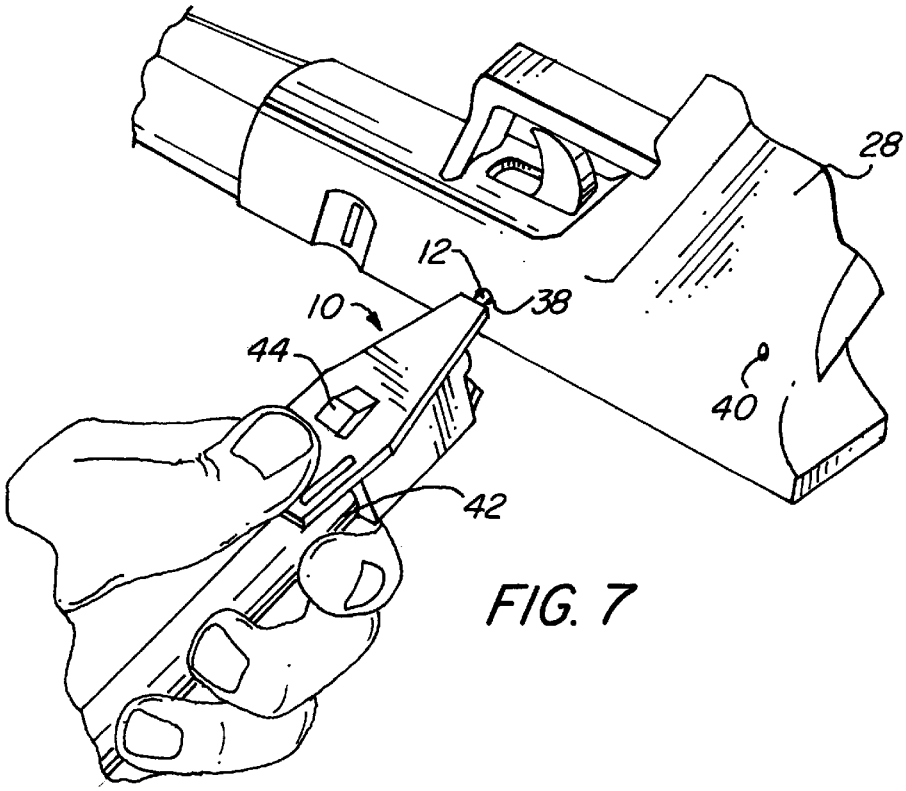
FIG. 7 is a perspective view illustrating the use of the present invention as a punch to remove pins in disassembling a pistol.

FIG. 7 is a perspective view illustrating the use and application of the firearm tool 10 of the present invention in removing a trigger pin 38. The firearm tool 10, being securely fixed to a barrel 42 facilitates holding and using the firearm tool 10 to remove pins for completely disassembling the firearm or pistol. Screwdriver tab 26 may also be utilized to pry or separate various components or parts in disassembling the pistol or firearm.

Referring to FIGS. 1 and 2, the elongated opening 22 may be utilized to remove the firearm tool 10 from the handle chamber 31. The elongated opening 22 may be sized to receive the rim or end of a cartridge which may be used to assist in grasping and removing the firearm tool 10 from the handle chamber 31. The screwdriver tab 26 may also be utilized in grasping the firearm tool 10 and pulling it from the handle chamber 31. The semi-circular opening 24, formed with the elongated opening 22, may provide sufficient clearance for attaching the firearm tool 10 to a keyring, should it be desired.

Accordingly, it should be appreciated that the present invention is a relatively simple, easily manufactured tool that may very conveniently be carried with a firearm or pistol at all times. The firearm tool 10 of the present invention greatly facilitates the complete disassembly of a firearm without the need to carry additional separate accessories or tools separately from the firearm or pistol.

Although the preferred embodiment has been illustrated and described, it will be obvious to those skilled in the art that various modifications may be mad without departing from the spirit and scope of this invention.

What is claimed is:

1. A firearm tool comprising:

a planar blank having a width adapted to fit within a handle of a firearm;

a punch formed on one end of said planar blank; and an adjustable side, whereby said adjustable side may be adjusted to selectively change the width of the firearm tool so as to be securely held within the handle of the firearm.

2. A firearm tool as in claim 1 further comprising:

an aperture disposed within said planar blank.

3. A firearm tool as in claim 2 wherein:

said aperture is adapted to fit over a portion of a barrel of the firearm.

4. A firearm tool as in claim 3 wherein:

said aperture has the shape of a quadrilateral.

5. A firearm tool as in claim 4 wherein:

the quadrilateral is a rectangle.

6. A firearm tool as in claim 1 wherein:

said adjustable side comprises a longitudinal slot placed adjacent at least one side of said planar blank.

7. A firearm tool as in claim 1 further comprising:

a screwdriver tab placed on the other end of said planar blank.

8. A firearm tool as in claim 1 further comprising:

a semi-circular opening placed on the other end of said planar blank.

9. A firearm tool as in claim 1 wherein:

the width of the firearm tool is narrower adjacent the punch and wider adjacent the other end.

10. A firearm tool for use in disassembling a pistol and adapted to be stored within the handle of the pistol, comprising:

a planar blank having two angled sides and two straight sides forming longitudinal edges, and a short lateral edge opposite a long lateral edge, the short lateral edge being shorter than the long lateral edge;

a cylindrical punch extending from the short lateral edge;

a centrally disposed rectangular aperture placed within said planar blank;

a first slot extending longitudinally adjacent one of the two straight sides;

a second slot extending longitudinally adjacent the other one of the two straight sides; and a semi-circular opening placed adjacent the long lateral edge, whereby the firearm tool can be stored in the handle of a pistol and carried at all times with the pistol until needed to disassemble the pistol, and in particular using said cylindrical punch to remove press fit pins in the pistol.

11. A firearm tool for use in disassembling a pistol and adapted to be stored within the handle of the pistol as in claim 10 further comprising:

a screwdriver tab extending from one side of the long longitudinal end.

12. A firearm and tool combination comprising:

a firearm having a handle;

a chamber in the handle of said firearm, said chamber having a first width; and a tool having a second width, the first width of said chamber being substantially equal to the second width of said tool so that said tool is adapted to fit within said chamber, whereby said tool can be conveniently carried within the handle of said firearm.

13. A firearm and tool combination as in claim 12 wherein:

said tool comprises a punch.

14. A firearm and tool combination as in claim 12 further comprising:

width adjustment means, associated with the sides of said tool, for adjusting the width of said tool, whereby said tool can be adapted to securely fit within said chamber within the handle of said firearm.

15. A firearm and tool combination as in claim 14 wherein:

said width adjustment means comprises longitudinal slots formed within said tool adjacent the sides of said tool.

16. A firearm and tool combination as in claim 12 wherein:

said tool comprises a screwdriver tab.

17. A firearm and tool combination comprising:

a firearm having a handle;

a chamber in the handle of said firearm, said chamber having a first width;

a tool having a second width, the first width of the said chamber being substantially equal to the second width of said tool so that said tool is adapted to fit within said chamber, said tool comprising a planar blank having two angled sides and two straight sides forming longitudinal edges, and a short lateral edge opposite a long lateral edge, the short lateral edge being shorter than the long lateral edge;

a cylindrical punch extending from the short lateral edge;

a centrally disposed square aperture placed within said planar blank;

a first slot extending longitudinally adjacent one of the two straight sides;

a second slot extending longitudinally adjacent the other one of the two straight sides; and a semi-circular opening placed adjacent the long lateral edge, whereby said tool can be conveniently and securely carried within the handle of said firearm.

* * * * *